US005681154A

United States Patent [19]

Yang

[11] Patent Number: 5,681,154

[45] Date of Patent: Oct. 28, 1997

[54] AIR PUMP WITH DUAL AIR INTAKES

[76] Inventor: Hsi-Kung Yang, No. 20, Lane 164, Yang-Ming Street, Pan-Chiao, Taipei Hsien, Taiwan

[21] Appl. No.: 779,121

[22] Filed: Jan. 6, 1997

[51] Int. Cl.[6] ..... F04B 21/04

[52] U.S. Cl. ..... 417/512; 417/524; 417/526

[58] Field of Search ..... 417/524, 525, 417/526, 527, 512

[56] References Cited

U.S. PATENT DOCUMENTS

| | | | |
|---|---|---|---|
| 3,485,180 | 12/1969 | Wickenberg et al. | 417/526 |
| 3,904,325 | 9/1975 | Olofsson et al. | 417/524 X |
| 5,165,876 | 11/1992 | Wang | 417/524 X |

*Primary Examiner*—Richard E. Gluck
*Attorney, Agent, or Firm*—Beveridge, DeGrandi, Weilacher & Young LLP

[57] ABSTRACT

An air pump with dual air intakes includes a hollow pump body, a securing cover, a piston rod, a piston, an air outlet, a check valve, an air duct and a handle. The pump body has one end connected to the air outlet and the check valve. The peripheral rim of the pump body near the air outlet is provided with multiple air inlets. A diaphragm is disposed at the inner side of the peripheral rim. The other end of the pump body is connected to the securing cover provided with multiple air inlets. A diaphragm is secured to the inner side of the securing cover. Both diaphragms may cover the corresponding air inlets. The piston is connected to one end of the piston rod and is provided with an annular groove at its periphery. The annular groove has through holes communicating with the piston rod and is fitted with an annular gasket. The piston rod has fitted therein the air duct connecting to the air outlet. The other end of the piston rod projects from the pump body and connected to the handle. The piston displaces towards the securing cover, and the diaphragm is pulled open to allow entry of air via the air inlets. When the piston displaces reversely, the diaphragm is pulled open to allow entry of air via the air inlets.

3 Claims, 5 Drawing Sheets

AIR PUMP WITH DUAL AIR INTAKES

BACKGROUND OF THE INVENTION (a) Field of the Invention

The present invention relates generally to an air pump, and more particularly to an air pump with dual air intakes.

(b) Description of the Prior Art Referring to FIG. 5, it shows a conventional air pump capable of unidirectional intake and discharge of air. The conventional air pump shown in FIG. 6 makes use of a piston to achieve bidirectional air discharge. However, its structure is very complicated and it does not provide bidirectional air intake. The pumping operation is also not smooth since the pressure at one end will be greater than that at the other end.

SUMMARY OF THE INVENTION

Accordingly, a primary object of the present invention is to provide an air pump with dual air intakes in which a diaphragm and multiple air inlets are provided at either end of the pump body and, by means of the motion of the piston rod, each stroke will drawn in air and discharge air.

To achieve the above object, the air pump of the present invention essentially comprises a hollow pump body, a securing cover, a piston rod, a piston, an air outlet, a check valve, an air duct and a handle. The pump body has one end connected to the air outlet and the check valve. The peripheral rim of the pump body near the air outlet is provided with multiple air inlets. A diaphragm is disposed at the inner side of the peripheral rim. The other end of the pump body is connected to the securing cover provided with multiple air inlets. A diaphragm is secured to the inner side of the securing cover. Both diaphragms may cover the corresponding air inlets. The piston is connected to one end of the piston rod and is provided with an annular groove at its periphery. The annular groove has through holes communicating with the piston rod and is fitted with an annular gasket. The piston rod has fitted therein the air duct connected to the air outlet. The other end of the piston rod projects from the pump body and connected to the handle. The piston displaces towards the securing cover, and the diaphragm is pulled open to allow entry of air via the air inlets. When the piston displaces reversely, the diaphragm is pulled open to allow entry of air via the air inlets.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
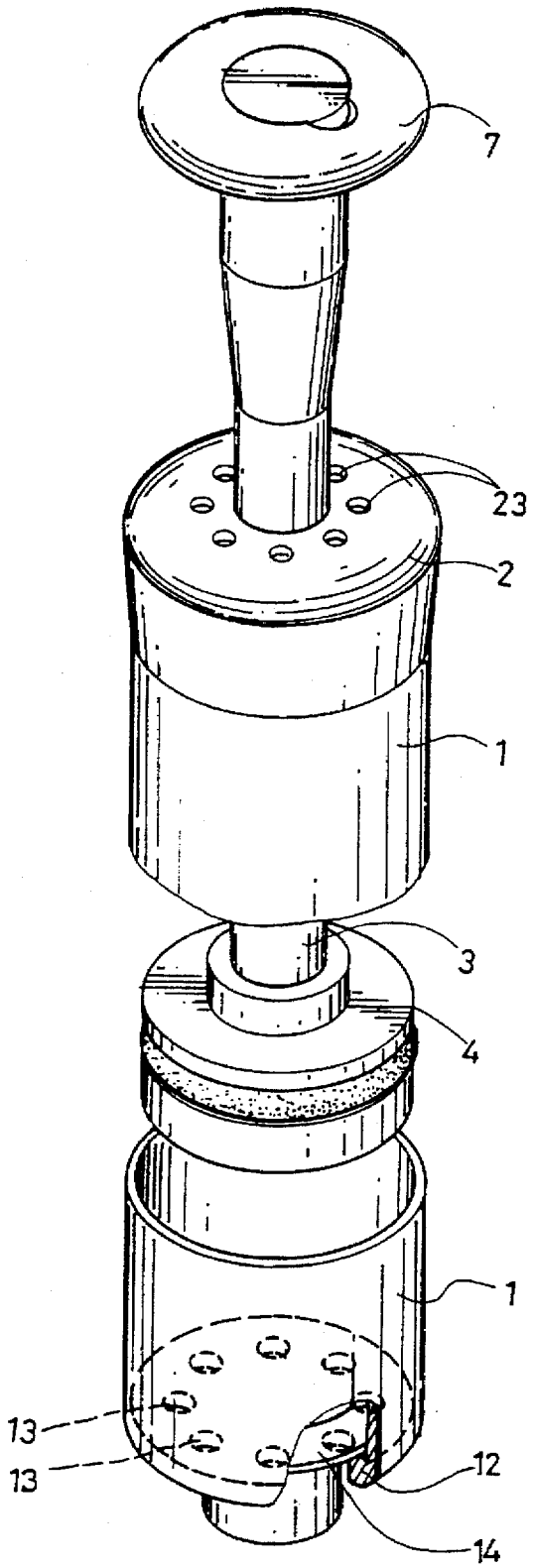
FIG. 1 is an elevational view of the present invention.
Figure 2:
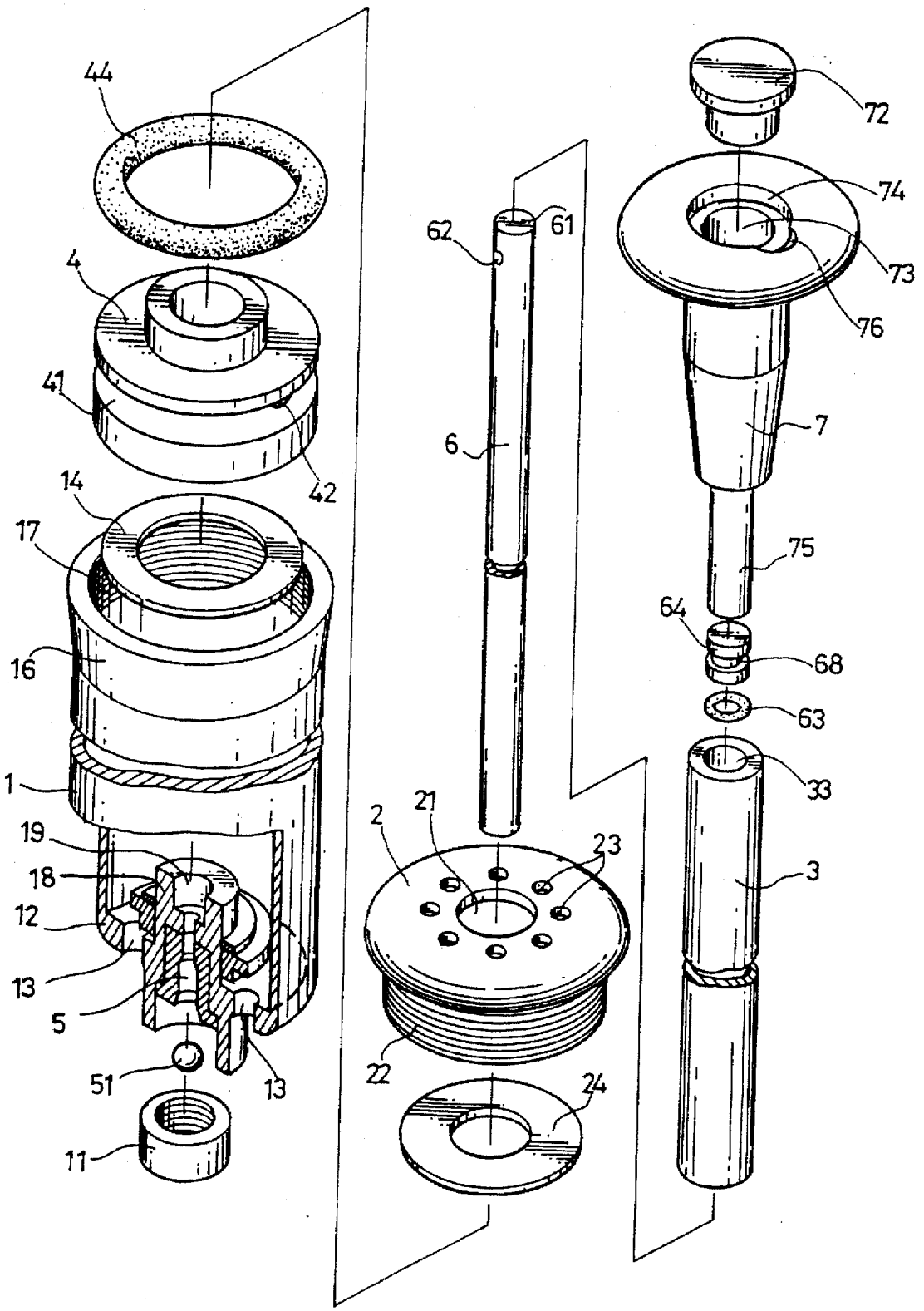
FIG. 2 is an elevational exploded view of the present invention.

The present invention is directed to an air pump with dual air intakes. With reference to FIGS. 1 and 2, it essentially comprises a hollow cylindrical pump body 1, a securing cover 2, a piston rod 3, a piston 4, an air outlet 11, a check valve 5, an air duct 6, two diaphragms 14, 24, and a handle 7.

The pump body 1 has one end extending inwardly to form a peripheral rim 12 and the air outlet 11 at the center of the peripheral rim 12. The check valve 5 is disposed inside the air outlet 11. The check valve 5 is a conical passage with a valve ball 51 in the middle. By means of the displacement of the valve ball 51, air may only go out through the air outlet 11 into which no air can be drawn. The peripheral rim 12 near the air outlet 11 is provided with a plurality of air inlets 13, and the diaphragm 14 is secured at a securing point 15 at the inner side of the peripheral rim 12.

The pump body 1 has the other end connected to the securing cover 2, which has outer threads 22 at its periphery for locking with the inner threads 17 of an open end 16 of the pump body 1. The securing cover 2 is provided with a plurality of air inlets 23 arranged in a ring. The diaphragm 24 in the shape of a ring is secured to the inner side of the securing cover 2. The inner rim of the diaphragm is secured at a securing point 25 at the inner side of the securing cover 2. The diaphragms 14, 24 may cover the corresponding air inlets 13, 23. The center of the securing cover 2 is a central hole 21 for passage of the piston rod 3 therethrough so that the piston rod 3 may enter into the pump body 1.

The piston 4 is connected to one end of the piston rod 3 and has an annular groove 41 at its periphery. The annular groove 41 has a plurality of through holes 42 communicating with a hollow tube 33 of the piston rod 3 and is also fitted with an annular gasket 44

The air duct 6 is fitted inside the piston rod 3 and has one end connected to the air outlet 11 so that one end of the air duct 6 is fixedly connected to a slot 19 of a securing block 18 in the peripheral rim 1. The hollow tube 33 of the piston rod 3 may just fit into the air duct 6. But the outer diameter of the air duct 6 is smaller than the inner diameter of the piston rod, with a clearance 66 defined therebetween so that the piston rod 3 may displace along the outer surface of the air duct 6. The other end of the piston rod 3 projects from the securing cover 2 to be connected to the handle 7. The other end of the air duct 6 is located in the piston rod 3 and is an enclosed end 61 so that air may travel between the air duct 6 and the hollow tube 33 to an air inlet 62 near the enclosed end 61, guiding air into an inner air path 67 of the air duct 6 and then along the air path 67 to the check valve 5 and the air outlet 11.

The handle 7 is cylindrical in shape with an upper end having an upwardly extending wing 71. The handle 7 tapers slightly towards its bottom end to form a recessed portion 75. The recessed portion 75 is inserted into one end of the hollow tube 33 of the piston rod 3 and is secured to the piston rod 3. The center of the wing 71 is a retaining seat 74 connected to a cock 72. The retaining seat 74 has a relatively large notch 76 to facilitate removal of the cock 72. The handle 7 has a hollow space 73 for insertion of an inflation pin 77 which may engage with the inner threads of the air outlet. In the present invention, the handle 7 has concealed therein an inflation pin to make good use of space.

The piston rod 3 has at least a part thereof lying against the air duct 6 to ensure that the air inlet 62 is covered up to prevent air leakage. The piston 4 is internally provided with an annular groove 45 fitted with a small annular gasket 65 in connect with the surface of the air duct 6. A small securing block 64 is engageably disposed between the enclosed end 61 of the air duct 6 and the hollow tube 33 of the piston rod 3. The small securing block 64 has an annular groove 68 fitted with a small annular gasket 63 to prevent air leakage.

Figure 3:
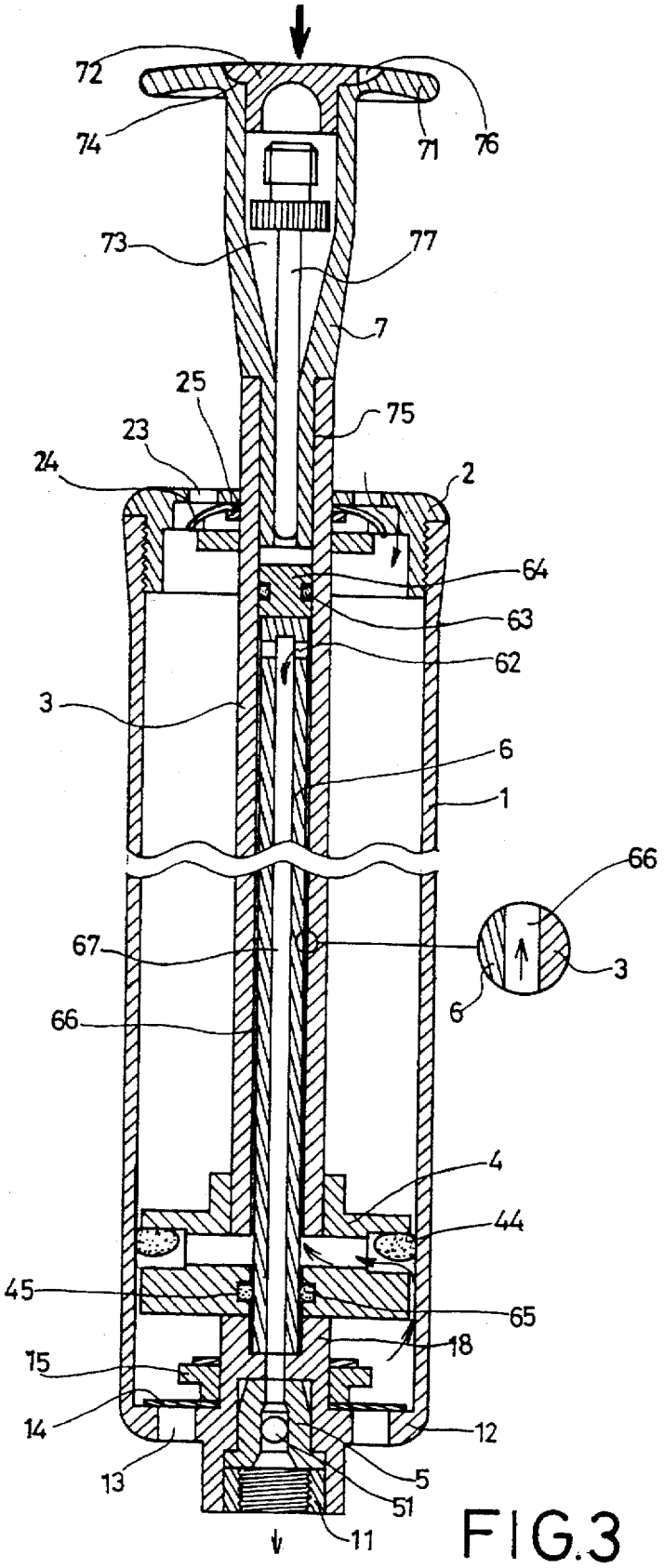
FIG. 3 is a sectional view of the present invention.
Figure 4:
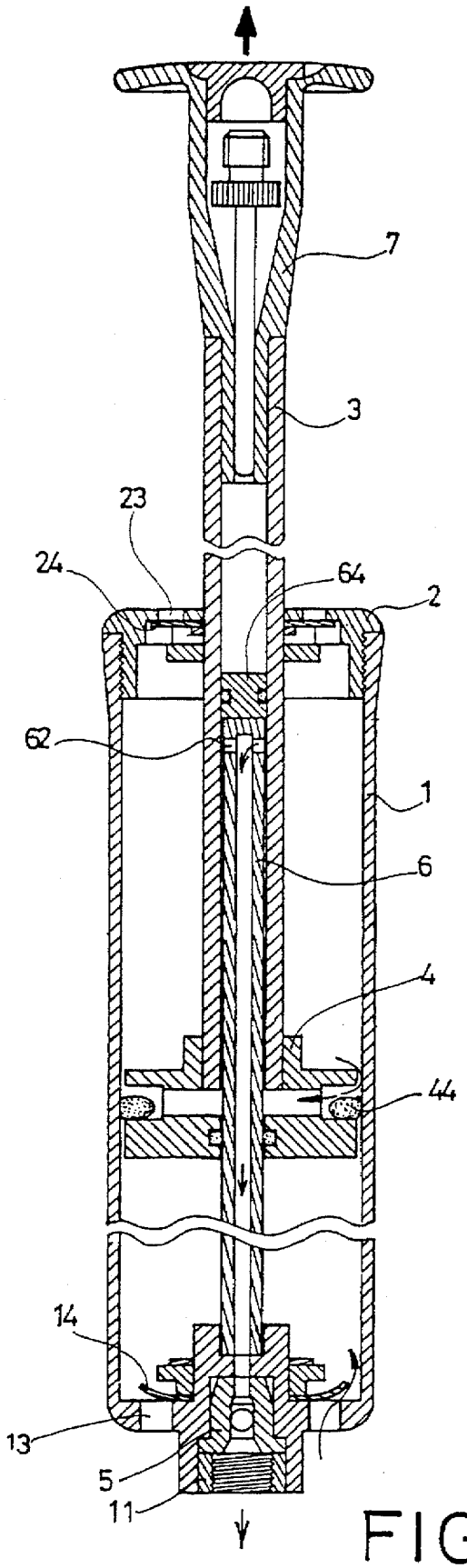
FIG. 4 is another sectional view of the present invention.
Figure 5:
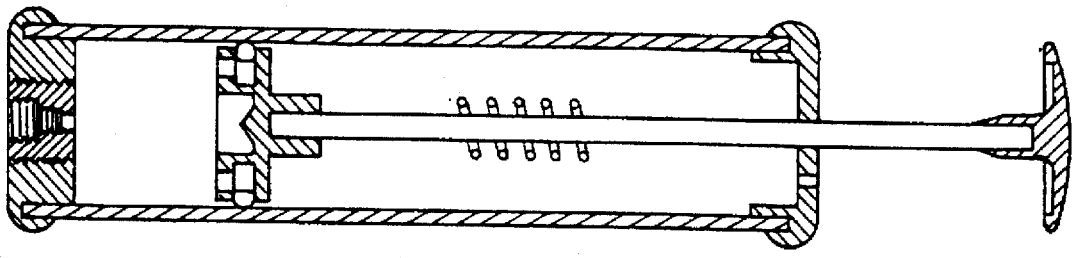
FIG.5 (PRIOR ART)
FIG. 5 is a sectional view of a conventional air pump.
Figure 6:
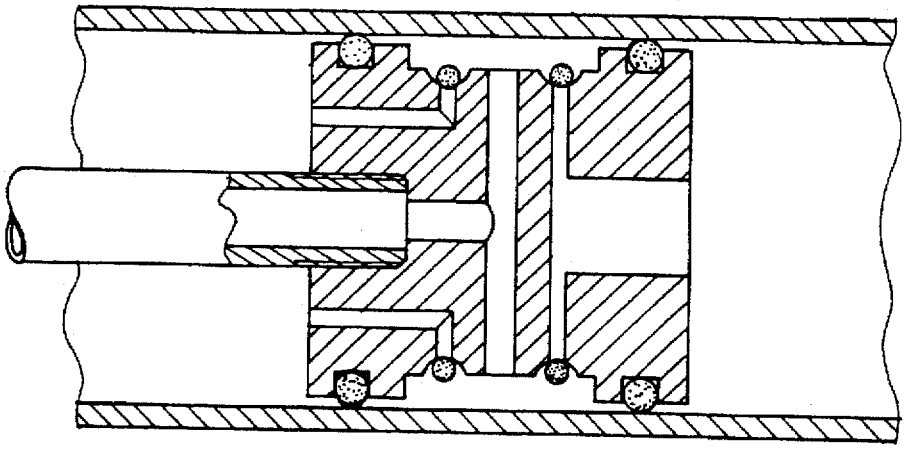
FIG.6 (PRIOR ART)
FIG. 6 is a sectional view of another conventional air pump.

As shown in FIG. 3, when the piston displaces from the peripheral rim to the securing cover, the diaphragm at the peripheral rim will be pulled open so that air may enter via the air inlets. At this point, the air at the other end of the piston will be affected by the pressure of the piston to tighten the diaphragm at the securing cover so that air travels via the space between the annular gasket and the annular groove through the through holes into the clearance between the piston rod and the air duct and to the air inlets into the air path of the air duct. Since the annular gasket will deviate to one side during displacement of the piston rod, air at the other end may be prevented from rushing thereinto and will allow simultaneously intake and discharge of air. Referring to FIG. 4, when the piston displaces from the peripheral rim to the securing cover, the diaphragm at the securing cover is drawn open so that air enters from the air inlets of the securing cover. Air is then discharged in the way described above. Thus, the pumping operation is made easy and quick.

In summary, the effects of the present invention essentially reside in that, by means of the diaphragms at the ends of the pump body being drawn open upon displacement of the piston, air may enter through the space between the annular gasket of the piston and the annular groove into the hollow tube of the piston rod through the check valve and out via the air outlet.

Although the present invention has been illustrated and described with reference to the preferred embodiment thereof, it should be understood that it is in no way limited to the details of such embodiment but is capable of numerous modifications within the scope of the appended claims.

What is claimed is:

1. An air pump with dual air intakes, comprising:

a pump body having an enclosed end forming an inwardly oriented peripheral rim with a securing point at an inner side thereof, said pump body further having an open end, said peripheral rim being provided with plurality of air inlets; a passage being formed in the center of said peripheral rim; said peripheral rim having a securing block with a slot therein;

a securing cover, said securing cover having its periphery connected to said open end of said pump body and being provided with a securing point at an inner side thereof, said securing cover further having a plurality of air inlets and a central hole;

two diaphragms, one of which has a diameter slightly smaller than the inner diameter of said pump body and is connected to the inner side of said peripheral rim to be retained by said securing point, the other of which has a diameter slightly smaller than the inner diameter of said securing cover and is connected to the inner side of said securing cover to be retained by said securing point, both of said diaphragms covering their corresponding air inlets and having the shape of a ring;

a piston rod having a hollow tube, one end of said piston rod being inserted through said central hole of said securing cover;

an air duct having an enclosed end at an upper end thereof, said enclosed end being provided with an air inlet and being inserted into said piston rod, said air duct having an open end connected to said slot of said securing block; a clearance being defined between said air duct and said piston rod; and said air duct having an air path;

a piston, said piston being connected to an inner end of said piston rod and being placed inside said pump body, said piston being provided with an annular groove at its periphery, said annular groove being provided with a plurality of through holes communicating with said piston rod, said air duct passing through said piston; said piston being internally provided with an annular groove fitted with a small annular gasket contacting the surface of said air duct;

a small securing block in the shape of a ring, said small securing block being arranged between said enclosed end of said air duct and said hollow tube of said piston rod, said small securing block having an annular groove fitted with a small annular gasket;

an annular gasket fitted onto said annular groove of said piston, said annular gasket displacing with said piston to locate at a position opposite to the direction of the displacement; a handle connected to a projected end of said piston rod, said handle being hollow and not covering said air inlets of said securing cover;

an air outlet connected to an outer side of said passage of said peripheral rim of said pump body; and a check valve connected to an inner side of said passage of said peripheral rim of said pump body and the inner side of said air inlet, said check valve communicating with said air duct; whereby when said handle is worked to cause said piston in said pump body to reciprocate along said air duct, said piston displaces away from said securing cover so that the diaphragm at said securing cover is drawn open to allow air in via said air inlets while the diaphragm at said enclosed end of said pump body is closed; the air staying in said pump body then travels via said annular groove near said annular gasket of said piston through said through holes into the clearance between said piston rod and said air duct into said air path via said air inlet of said air duct and out through said check valve and said air outlet, thus accomplishing cyclic air intake and continuous air discharge.

2. An air pump as claimed in claim 1, wherein said open end of said pump body is provided with inner threads for engaging the outer threads of said securing cover.

3. An air pump as claimed in claim 1, wherein said handle has a wing extending outwardly from an upper end thereof, said handle tapering slightly downwardly to form a recessed portion for insertion into said hollow tube of said piston rod and securing thereto, said wing being provided with a retaining seat at its center, said retaining seat having a cock and a relatively large notch to facilitate removal of said cock, said handle having a hollow space in its interior for accommodating an inflation pin.

* * * * *